United States Patent [19]

Nagano

[11] Patent Number: 4,666,420

[45] Date of Patent: May 19, 1987

[54] TOY CAR OF A FRONT WHEEL DRIVING TYPE

[75] Inventor: Toshiaki Nagano, Tokyo, Japan

[73] Assignee: Shinsei Kogyo Co., Ltd., Tokyo, Japan

[21] Appl. No.: 736,089

[22] Filed: May 20, 1985

[51] Int. Cl.[4] ..... A63H 30/04; A63H 17/36

[52] U.S. Cl. ..... 446/443; 446/437; 446/456; 446/466; 446/460

[58] Field of Search ..... 446/437, 443, 454, 455, 446/456, 466, 460; 180/6.48, 6.5, 209

[56] References Cited

U.S. PATENT DOCUMENTS

| | | | |
|---|---|---|---|
| 1,619,726 | 3/1927 | Heyman | 446/437 |
| 1,651,292 | 11/1927 | Ramage | 446/437 X |
| 2,460,198 | 1/1949 | Kember | 180/209 |
| 3,772,824 | 11/1973 | Terzian et al. | 446/437 X |
| 3,984,939 | 10/1976 | Wolgamot et al. | 446/437 X |
| 4,197,672 | 4/1980 | Mabuchi et al. | 446/456 |
| 4,361,200 | 11/1982 | Igarashi | 180/209 X |
| 4,457,101 | 7/1984 | Matsushiro | 446/456 |
| 4,508,516 | 4/1985 | D'Andrade et al. | 446/454 X |
| 4,556,397 | 12/1985 | Arad et al. | 446/437 X |

FOREIGN PATENT DOCUMENTS

| | | | |
|---|---|---|---|
| 583829 | 9/1933 | Fed. Rep. of Germany | 446/437 |
| 52-24904 | 7/1977 | Japan . | |
| 58-136198 | 9/1983 | Japan . | |

*Primary Examiner*—Mickey Yu

*Attorney, Agent, or Firm*—Sandler & Greenblum

[57] ABSTRACT

The present invention relates to a front wheel drive toy car having front wheels for driving and changing direction which includes a chassis and a lifting rod connected to the chassis for supporting a rear axle. The car includes a hinge for pivotally securing the lifting rod so as to allow the lifting rod to move away from and toward the chassis, a setting device connected to the lifting rod for setting a pivot position, and a bumper arranged at a front of the chassis for preventing forward tumble of the car over a front axle when forward movement is suddenly changed to backward movement. The swing angle of the lifting rod is set at a position such that the car will tumble forward toward the front axle upon a sudden direction change from forward movement to backward movement.

7 Claims, 8 Drawing Figures

TOY CAR OF A FRONT WHEEL DRIVING TYPE

FIELD OF THE INVENTION

This invention relates to a toy car of a front wheel driving type, more particularly to such toy car having a direction-converting or direction-changing device.

BACKGROUND OF THE INVENTION

Heretofore, there has not been proposed any toy car, which permits running with the rear of chassis in the air in addition to the usual type of driving, similar to wheeley running of an motorcycle.

On the other hand, there has hitherto been proposed a direction-converting device in which a driving power is transmitted from a single motor through a steering plate and a link mechanism to front wheels. Such device, however, provides only a narrow range of steering operation.

An object of the invention is to provide a toy car which permits a rear-up running in addition to the usual type of driving, similar to wheeley running of an motorcycle.

Another object of the invention is to provide a toy car which permits a back-wheeley running, namely a backward running or moving backwards, with the rear wheels of the car being lifted up.

A further object of the invention is to provide a toy car having a direction-converting device which permits a rapid and small sharp turn with quick response and an active feeling of steering operation.

A still further object of the invention is to provide a toy car having a direction-converting device without any complicated mechanism and thus with a very simple construction, leading to reduction of the manufacturing costs.

SUMMARY OF THE INVENTION

In accordance with the invention there is provided a front wheel drive toy car having front wheels for driving and changing directions, which includes a chassis and a lifting rod connected to the chassis for supporting a rear axis. The car includes a hinge for pivotally securing the lifting rod so as to allow the lifting rod to move away from and toward the chassis, a setting means connected to the lifting rod for setting a pivot position, and a bumper arranged at a front of the chassis for preventing forward tumble of the car over a front axle when forward movement is suddenly changed to backward movement. The swing angle of the lifting rod is set at a position such that the car will tumble forward toward the front axle caused by forward running inertia upon a sudden direction change from forward movement to backward movement.

The toy car according to the invention further comprises a direction converting device serving also as a front wheel drive mechanism, which includes at least two front wheel carrying bodies swingably supported by the chassis on vertical axis and at least two front wheels supported by the carrying bodies perpendicularly to the vertical axis. The direction changing device also includes a tie rod connecting the at least two carrying bodies to one another in swingable association and power transmission means for transmitting driving power from at least one independently mounted motor to the at least two front wheels.

The invention will be described hereinbelow in more detail with reference to the accompanying drawings.

PREFERRED EMBODIMENTS OF THE INVENTION

Figure 1:
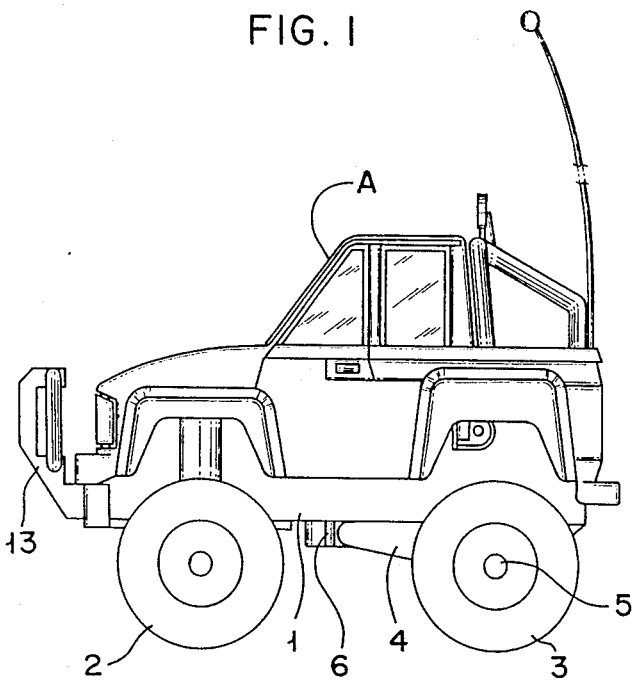
FIG. 1 is a schematic view of the toy car according to the invention.
Figure 2:
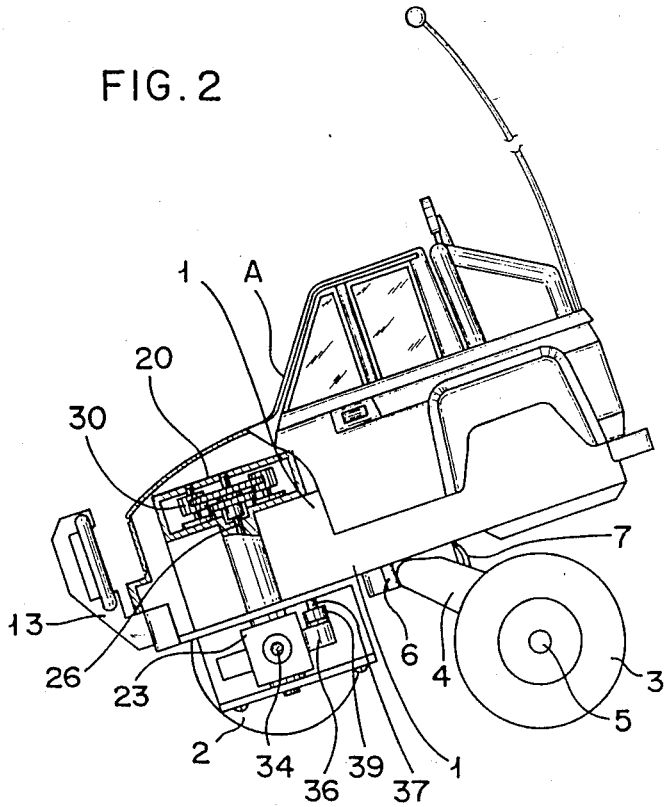
FIG. 2 is a partially sectional side view of the toy car with its rear being lifted up.

In the drawings a reference numeral 1 represents a chassis, at the front of which is arranged a front wheel driving mechanism 20 having both driving and direction-converting or direction-changing functions. Further, the chassis at its rear is provided with rear wheels 3 inserted through a lifting rod 4 for raising the chassis 1.

Figure 3:
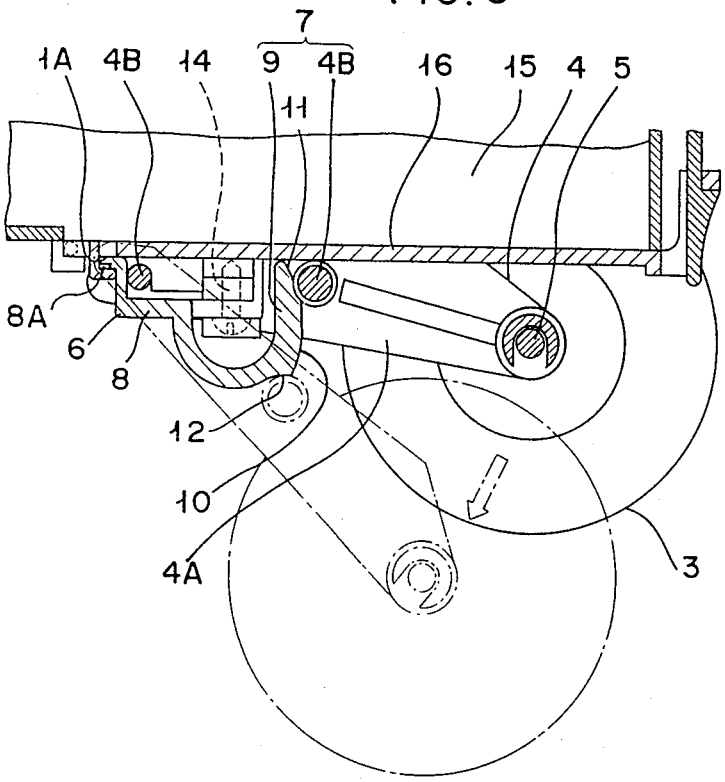
FIG. 3 is a vertical section of main portions.
Figure 8:
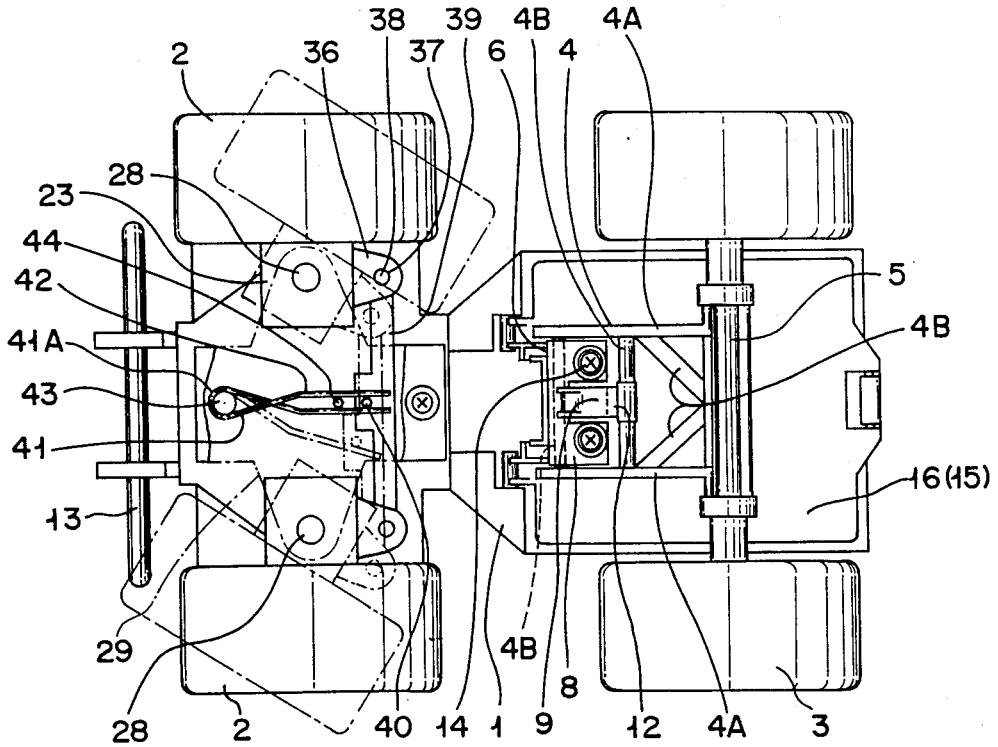
FIG. 8 is a partially omitted bottom view of the toy car according to the invention.

The lifting rod 4 supports a rear axle 5 securing the rear wheels 3 and is swingable so as to allow the rear wheels 3 to move away from and toward the chassis 1. The lifting rod 4 comprises a pair of rods 4A, 4A and a stay 4B for connecting the rods 4A, 4A together to form a rectangular frame as best illustrated in FIG. 8. Further, there is provided a hinge 6, in the vicinity of which is arranged a setting means 7 for fixing the swing position of the lifting rod 4 as best shown in FIG. 3. The hinge 6 is secured to the chassis 1 by means of a bracket 8 for rotatably holding the stay 4B as a pivot pin. The stay 4B is located on the opposite side to the rear axle, as shown in FIG. 3.

The lifting rod 4 is provided with the setting means 7 for fixing the swing position of the lifting rod 4, as stated above. The setting means 7 comprises, as shown in FIG. 3, an engaging piece 9 of a substantially half circle in section projected from a center of the bracket 8 and the stay 4B at a middle portion of the lifting rod 4A for engaging the piece 9. The engaging piece 9 at its periphery is provided with an engaging projection 10, an upper face of which serves as an engaging face 11 for the stay 4B during a usual driving, while its lower face serves as an engaging face 12 for the stay 4B during back-wheeley running. A position of the engaging face 12 for back-wheeley running is determined in such a way that the lifting rod 4 is fixed at an inclined position for tumbling the car body A on front axle 34 as a result of forward running inertia upon sudden change from the forward running or movement to the backward running or movement.

Further, the car body A at its front is provided with a bumper 13 for preventing the forward tumble as just described previously. The bumper 13 may also prevent the tumble during the back-wheeley running.

The bracket 8 (FIG. 3) may be conveniently secured to a bottom of the chassis 1 by means of a fitting portion 8A which is engaged with a fitting aperture 11A formed at the bottom of the chassis 1, and then fasten with a screw 14. The bottom plate of the chassis 1 for securing the bracket 8 serves also as a cover 16 for a battery chamber 15.

Figure 5:
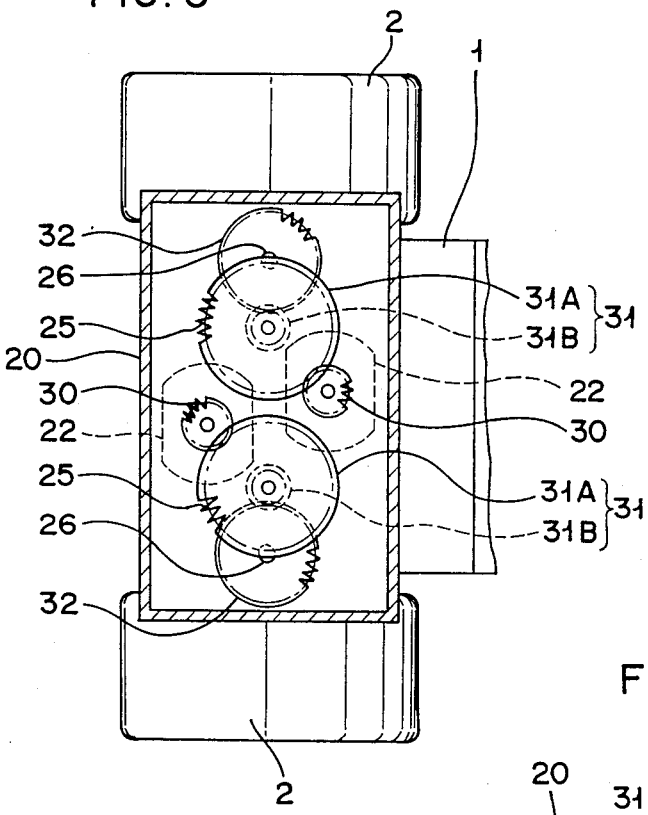
FIG. 5 is a partially broken plan view of a front wheel driving mechanism, or a direction-converting device useful in the invention.
Figure 6:
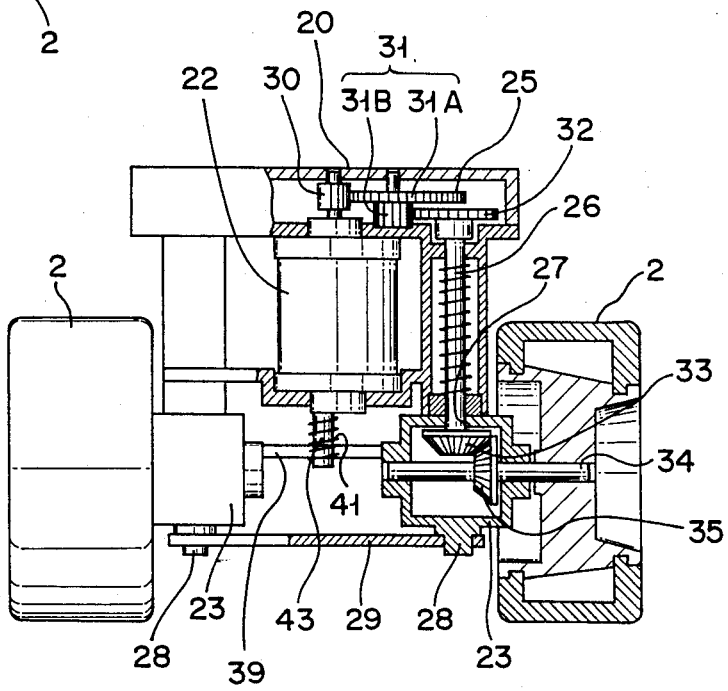
FIG. 6 is a front view of the device of FIG. 5.
Figure 7:
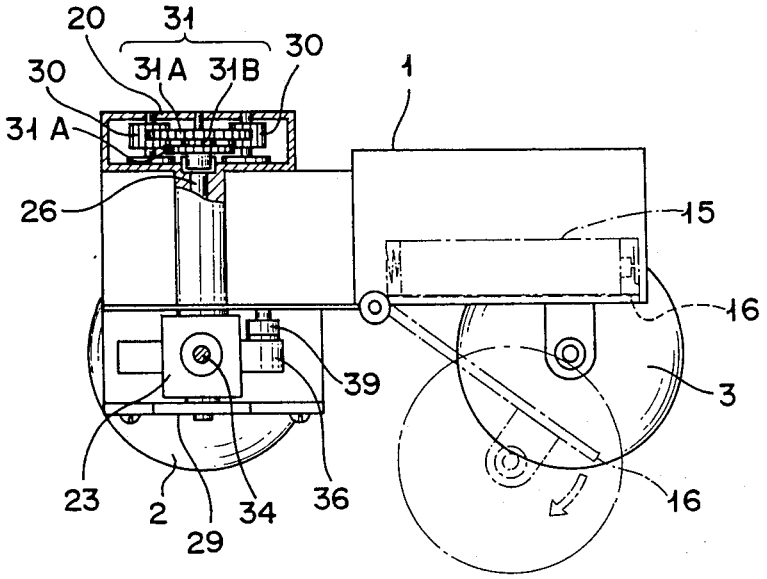
FIG. 7 is a side view of the device of FIG. 5.

The front wheel driving mechanism 20, or the direction-converting device used in the invention may be formed as shown in FIGS. 5 to 7. The chassis 1 at its front portion is provided with a pair of motors 22 with their driving shafts being oriented vertically. The chassis 1 at its lower front end is further provided with a pair of front wheel carrying bodies 23 swingably mounted on their vertical axes. Front wheels 2 are supported by bodies 23 perpendicularly to the vertical axes. The front wheels 2 and the motors 22 are associated through a pair of power transmission means 25.

Each front wheel carrying body 23 is a substantially rectangular box having on its upper surface a supporting hole 27 for passing a transmission shaft 26 therethrough and on its lower surface a pivot pin 28 projects therefrom. The transmission shaft 26 may also serve as the pivot pin of the carrying body 23. In other words, the carrying body 23 may be mounted to the chassis 1 by means of the transmission shaft 26 passing through the hole 27 and the pivot pin 28. A reference numeral 29 represents a mounting plate for holding the pivot pin 28 rotatably and securing the carrying body 23 to the chassis 1.

Each power transmission means 25 includes a driving gear 30 fixed to an upper end of a driving shaft of the motor 22. Gear 30 is meshed with a driving wheel 31A of a reduction gear 31 while driven wheel 31B is meshed with a follower gear 32. A center axis of the transmission shaft 26 of the follower gear 32 is aligned with a center axis of the pivot pin 28 of the front wheel carrying body 23. In the carrying body 23, the transmission shaft 26 at its one end is fixedly provided with a driving bevel gear 33, while a front axle 34 in the carrying body 23 is fixedly provided with a driven bevel gear 35 meshed with the driving bevel gear 33. Thus, the pair of motors 22 may be independently and individually associated with the pair of front wheels 2.

As shown in FIG. 8, the front wheel carrying bodies 23 at their rear sides are provided with receiving plates 36 from which are projected pins 37 vertically. These pins 37 are inserted into engaging holes 38 of a tie rod 39. Thus, the pair of front wheel carrying bodies 23 may be swingably associated with each other through the tie rod 39.

The tie rod 39 is provided at its longitudinal center with a projected restoring pin 40 which is engaged with engaging ends of a restoring spring 41 arranged on a front bottom face of the chassis 1. The restoring spring 41 consists of a coil spring 41A extending its either end straight to form the engaging ends 42 and is secured by a mounting pin 43 and a swing-restricting pin 44. The pair of engaging ends 42 of the coil spring 41 are arranged in parallel to each other after crossing, as shown in FIG. 8, and hold the swing-restoring pin 40 elastically therebetween.

In FIG. 3, a reference numeral 16 represents a cover for supporting rear wheels 3 and also serves as a cover for a battery case 15 arranged at a rear portion of the chassis 1.

In operation, the pair of motors 22 are connected to a receiver (not shown) of a remote control apparatus and applied with equal voltage or one of the motors 22 may be applied with a reduced voltage to change the direction of movement. Alternatively, an electric current for either one of the motors 22 may be discontinued to change the direction.

For the rear-up running that is, moving with the rear of the chassis lifted in the air, the rear axle 5 may be withdrawn upwardly, or downwardly when appropriate, by lifting the rod 4 in an inclined relationship to the bottom face of the chassis 1 and thereby causing the rear to be lifted up. Then, a radio controller (not shown) may operate and steer the toy car. The user of the toy car can move lifting rod 4 upwardly to cause the car to be operated with the chassis 1 in an upward position.

Figure 4:
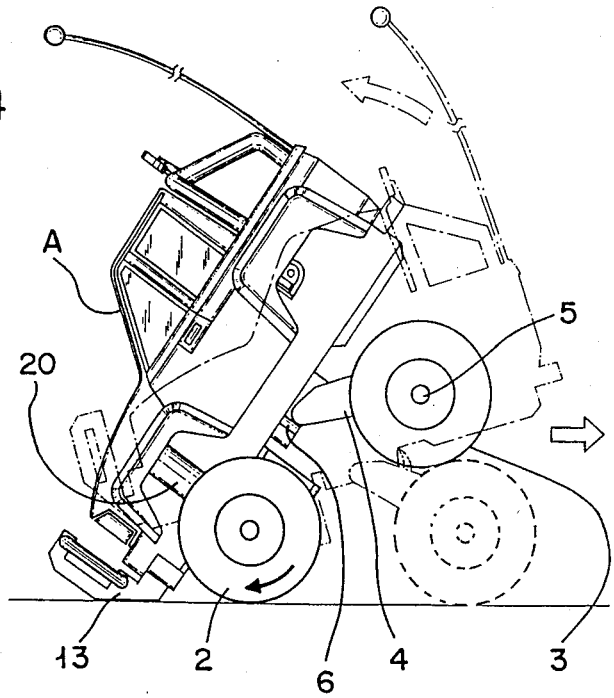
FIG. 4 is a schematic side view of the toy car in a back-wheeley running.

During rear-up running, forward running or movement may be suddenly changed to backward running or movement for achieving back-wheeley running, as shown in FIG. 4. In other words, the sudden change from the forward to the backward allows the car body A to suddenly stop and immediately thereafter to move backwardly. At this sudden stop, the car body A is subjected to a front running inertia and tends to rotate so as to tumble forward on the front axle 34. This tumbling movement may be prevented by the bumper 13 at the front of the car body A; the car is then moved backwardly by reverse rotation of the front wheels 2. Acceleration during the backward movement may allow the car body A to keep its forward inclination and thereby to permits the back-wheeley running with the rear wheels 3 being maintained in the lifted position.

In accordance with the invention, the toy car having the front wheels 2 for both driving and direction-converting functions comprises the chassis 1, the lifting rod 4 for the chassis 1 for supporting the rear axle 5, the hinge 6 for swingably securing the lifting rod 4 so as to allow the lifting rod 4 to move away from and toward the chassis 1, and the setting means 7 arranged at the lifting rod 4 for setting its swing position, so that the rear-up running in addition to the usual driving may be possible with a simple construction.

Further, the swing angle of the lifting rod 4 is set at a position for setting the setting means 7 corresponding to the degree of front tumbling of the car body A onto the front axle 34 because of the forward running inertia upon the sudden change of the forward running or movement to the backward running or movement In this way back-wheeley running that is, movement with the rear wheels in the air, may be readily achieved.

Further, the bumper 13 is arranged at the front of the car body A for preventing its forward tumble on the front axle 34 upon the sudden change in the running direction, so that the back-wheeley running may be achieved without tumbling of the car body A.

In addition, the toy car of the invention has the front wheel driving mechanism 20, or the direction-converting device comprising the chassis 1, the front wheel carrying bodies 23 supported to the chassis 1 swingably on their vertical axes, the front wheels 2 supported by the carrying bodies 23 perpendicularly to the vertical axes, the tie rod 39 combining the carrying bodies 23 together in the swingable association, and the power transmission means 25 for transmitting the driving power from each of the independent motors 22 to a respective front wheel 2, so that the control of power supply to each motor 22 may readily change the running direction, or achieve the straight running and the active turn.

Thus, equal rotation of both motors 22 permits the straight running, or the rotation of either one of the motors 22 may be slowed down or discontinued to permit the turning operation. Consequently, the device according to the invention is very simple in its construction without need of the conventional complicated device, such as a motor and an electromagnet for changing the direction.

Further, change of a rotational rate of the one motor 22 relative to the other may cause a rotation ratio of the one wheel 2 to the other to be unbalanced, thereby to permit the turning. Then, the turning operation allows the other carrying body 23 to swing for orienting the front wheels 2 toward the direction of movement. The swing movement is then transmitted through the tie rod 39 to the one carrying body 23. Thus, comparing with the conventional direction-converting device of the prior art for changing a rotation rate of a single motor or only one of motors, the device according to the invention may achieve more smooth, rapid and small sharp turn, resulting in a very amusing and active toy car of a very simple construction.

Further, in accordance with the device of the invention, the power transmission means 25 comprises the driving gear 30 of the motor 22, the reduction gear 31 having the driving wheel 31A meshed with the driving gear 30 and having the driven wheel 31B meshed with the follower gear 32 which has the transmission shaft 26 aligning with the pivot pin 28 of the carrying body 23, the driving bevel gear 33 fixed to one end of the transmission shaft 26 in the carrying body 23, and the driven bevel gear 35 fixed to the front axle 34 and meshed with the driving bevel gear 33 in the carrying body 23, so that the driving power may be transmitted to the front wheels 2 supported to the carrying bodies 23 through the simple mechanism and construction. The swing movement of the front wheel carrying bodies 23 is not inhibited by the power transmission means 25.

As described hereinabove, the toy car according to the invention is very simple in its construction and permits a rear-up running and a back-wheeley running, as well as a rapid or quick-responsive and small sharp turn, thereby to provide an improved and interesting steering operation.

What is claimed is:

1. A front wheel drive toy car having front wheels for driving and changing directions, comprising:

(a) a chassis;

(b) a lifting rod connected to said chassis for supporting a rear axle;

(c) a hinge for swingably securing said lifting rod to said chassis such that said lifting rod can move away from and toward said chassis;

(d) setting means mounted to said chasis and engaged with said lifting rod for setting a swing position of said lifting rod corresponding to an angle with respect to said chassis such that said car will tumble forward toward a front axle when forward movement is suddenly changed to backward movement; and (e) a bumper comprising a substantially inclined face inclined with respect to a support surface for supporting said toy car, said inclined face being of a sufficient size such that said bumper being connected to a front of said chassis prevents said car from rolling forward over said front axle when said inclined face engages said support surface when forward movement of said car is suddenly changed to backward movement.

2. The toy car according to claim 4, further comprising a direction changing device comprising a front wheel driving mechanism, which comprises:

(a) two front wheel carrying bodies swingably connected to said chassis such that said two front wheel carrying bodies each are pivotable about a respective pivot point along vertical axes with respect to said chassis which pass through each of said two front wheel carrying bodies;

(b) two front wheels each having an axle supported by said carrying bodies perpendicularly to said vertical axes;

(c) a tie rod swingably connecting said two carrying bodies to each other; and (d) power transmission means for transmitting driving power from two independently operable motors to said two front wheels.

3. The toy car according to claim 2, wherein the power transmission means comprises:

(a) at least one driving gear of at least one motor;

(b) at least one reduction gear having a driving wheel meshed with said at least one driving gear and a driven wheel meshed with a follower gear which has a transmission shaft aligned with a pivot pin of each of said carrying bodies;

(c) at least one driving bevel gear fixed to one end of the transmission shaft aligned with the pivot pin of each of said two front wheel carrying bodies.

4. A front wheel drive toy car adapted to be operated on a running surface, said toy car having a chassis and a rear axle comprising:

(a) at least two front wheels mounted on said chasis for driving and changing direction;

(b) means connected to said chasis for maintaining said chassis in an inclined position with respect to said running surface;

(c) means for operating said car in a forward and backward direction when said chassis is in the inclined position with respect to said running surface; and (d) a bumper comprising a substantially inclined face inclined with respect to said running support, surface for supporting said toy car, said inclined face being of a sufficient size such that said bumper being connected to a front of said chassis prevents said car from tumbling over forwardly when said inclined face engages said running surface when a forward movement of said car is suddenly changed to a backward movement.

5. A front wheel drive toy car according to claim 4 wherein said means for maintaining comprises:

(a) a lifting rod connected between said chassis and said rear axle;

(b) a hinge for pivotally connecting said lifting rod to said chassis; and (c) setting means for setting said lifting rod in a predetermined pivot position.

6. A front wheel drive toy car according to claim 4 wherein said means for operating comprises:

(a) at least two front wheel supports connected to said chassis and pivotable about respective pivot points along vertical axes with respect to said chassis, said axes pass through respective said at least two front wheel supports, said at least two front wheels supported by said at least two front wheel supports perpendicular to said vertical axes;

(b) a tie rod for rotatably connecting said at least two front wheel supports to said chassis; and (c) power transmission means for operatively connecting said at least two front wheels to at least two independently mounted motors.

7. A front wheel drive toy car according to claim 6, wherein said power transmission means comprises a plurality of gears, said plurality of gears comprising:

(a) at least two driving gears mounted to said at least two independently mounted motors;

(b) at least two reduction gears each having a driving wheel meshed with a corresponding driving gear and a driven wheel meshed with a corresponding follower gear, each of said follower gears having at least one transmission shaft aligned with a pivot pin of each of said at least two front wheel supports;

(c) at least two driving bevel gears, each of said at least two driving bevel gears being fixedly attached to one end of one of said transmission shaft; and (d) at least two driven bevel gears fixedly attached to respective front axles, said at least two driven bevel gears being meshed with said at least two driven bevel gears.

* * * * *

UNITED STATES PATENT AND TRADEMARK OFFICE

CERTIFICATE OF CORRECTION

PATENT NO. : 4,666,420

DATED : May 19, 1987

INVENTOR(S) : Toshiaki Nagano

It is certified that error appears in the above-identified patent and that said Letters Patent is hereby corrected as shown below:

Column 1, line 22, delete "a".

Column 1, line 23, "an" should read -- a --.

Column 1, line 25, delete "a", both occurrence.

Column 2, line 67, "fasten" should read -- fastened --.

Column 4, line 24, delete "to".

Column 4, line 41, after "movement" insert -- . --.

Column 5, line 48, "chasis" should read -- chassis --.

Signed and Sealed this

Thirteenth Day of September, 1988

*Attest:*

DONALD J. QUIGG

*Attesting Officer*

*Commissioner of Patents and Trademarks*